US006129583A

United States Patent [19]

Lok

[11] Patent Number: 6,129,583

[45] Date of Patent: Oct. 10, 2000

[54] MODULAR JACK HAVING WIRE-RETAINING SPACER

[75] Inventor: Gordon Lok, Montebello, Calif.

[73] Assignee: Hon Hai Precision Inc. Co., Ltd., Taipei Hsien, Taiwan

[21] Appl. No.: 09/221,640

[22] Filed: Dec. 28, 1998

[51] Int. Cl.[7] ..... H01R 13/73

[52] U.S. Cl. ..... 439/545; 439/79; 439/942

[58] Field of Search ..... 439/79, 55, 545, 439/571, 942

[56] References Cited

U.S. PATENT DOCUMENTS 3,245,024 4/1966 Evans ..... 439/67
5,171,155 12/1992 Mendoza ..... 439/134
5,560,981 10/1996 Ito ..... 428/209
5,921,805 7/1999 Tabata et al. ..... 439/457

*Primary Examiner*—Brian Sircus
*Assistant Examiner*—Michael C. Zarroli
*Attorney, Agent, or Firm*—Wei Te Chung

[57] ABSTRACT

A modular jack includes an insulative housing, a cavity defined in the housing, and a plurality of contacts extending into the cavity for connecting with wires extending from a lower portion of a rear face of the housing. A retaining spacer is integrally formed on a middle portion of the rear face of the housing. The spacer defines a plurality of grooves for snugly receiving a corresponding plurality of wires therein, respectively. The provision of the retaining spacer promotes conservation of space on the PCB on a portion thereof adjacent to the rear face of the housing of the modular jack.

5 Claims, 2 Drawing Sheets

MODULAR JACK HAVING WIRE-RETAINING SPACER

BACKGROUND OF THE INVENTION

1. Field of the Invention

The present invention relates to a modular jack, and particularly to a modular jack having a retaining spacer for preventing wires extending therefrom from occupying too much space on a PCB.

2. The Prior Art

A modular jack is a commonly used electrical connector in telecommunication devices. The jack is mounted onto a PCB and wires extending therefrom into an interior of the device occupy a significant amount of space on the PCB. As the trend of the electronics industry continues toward miniaturization, space on the PCB must be effectively conserved. Hence, an improved modular jack which promotes conservation of space is requisite.

SUMMARY OF THE INVENTION

Accordingly, an objective of the present invention is to provide a modular jack having a retaining spacer integrally formed on a rear side thereof for retaining wires extending from a housing of the jack therein.

To fulfill the objective mentioned above, a modular jack in accordance with the present invention includes an insulative housing, a cavity defined in the housing, and a plurality of contacts extending into the cavity for connecting with wires extending from a lower portion of a rear face of the housing. A retaining spacer is integrally formed on a middle portion of the rear face of the housing. The spacer defines a plurality of grooves for snugly receiving a corresponding plurality of wires therein, respectively. The provision of the retaining spacer promotes conservation of space on the PCB on a portion thereof adjacent to the rear face of the housing of the modular jack.

These and additional objectives, features, and advantages of the present invention will become apparent after reading the following detailed description of the preferred embodiment taken in conjunction with the appended drawing figures.

DETAILED DESCRIPTION OF THE PREFERRED EMBODIMENT

Reference will now be made in detail to the preferred embodiment of the present invention.

Figure 1:
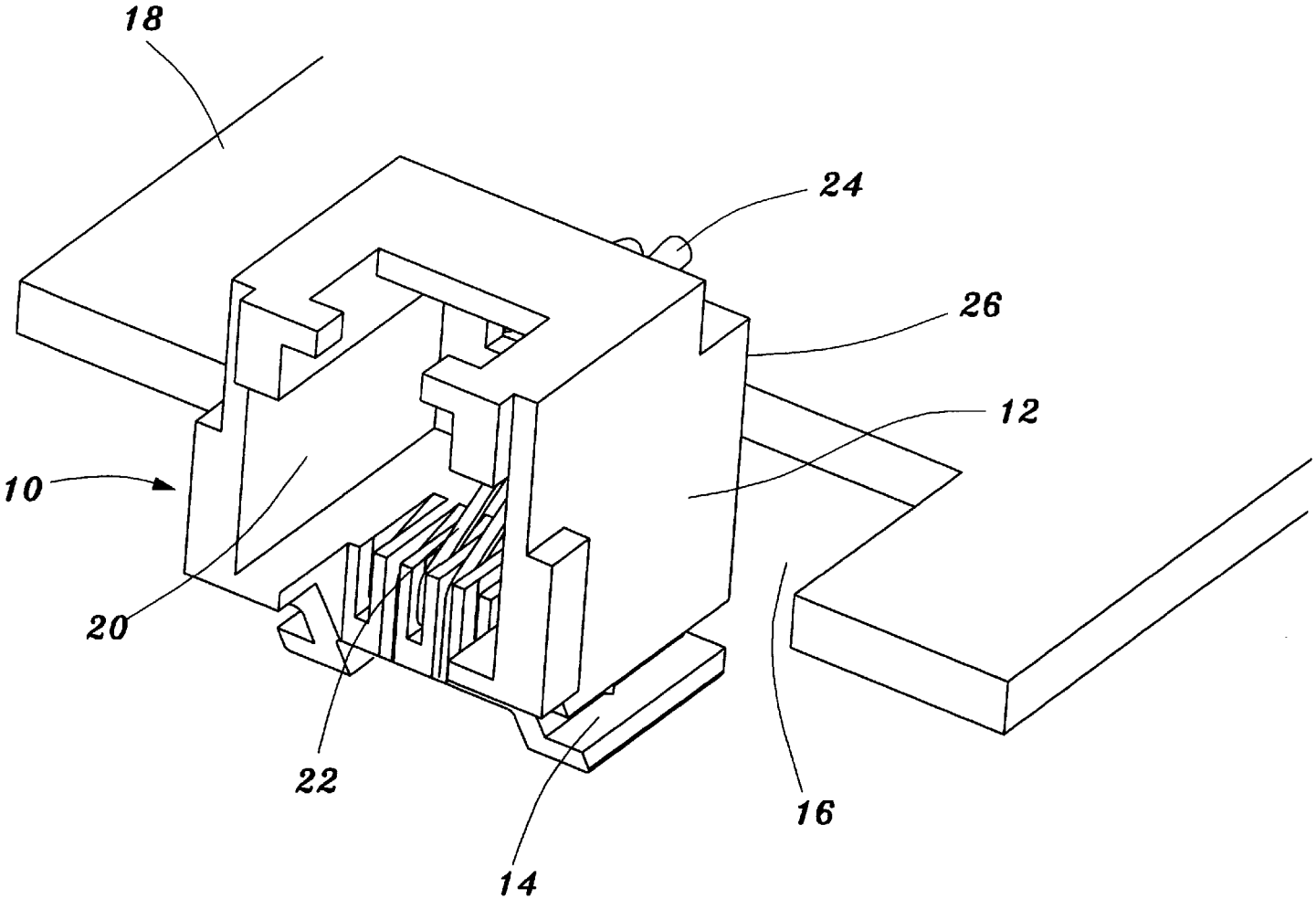
FIG. 1 is a front perspective view of a modular jack in accordance with the present invention and a PCB.
Figure 2:
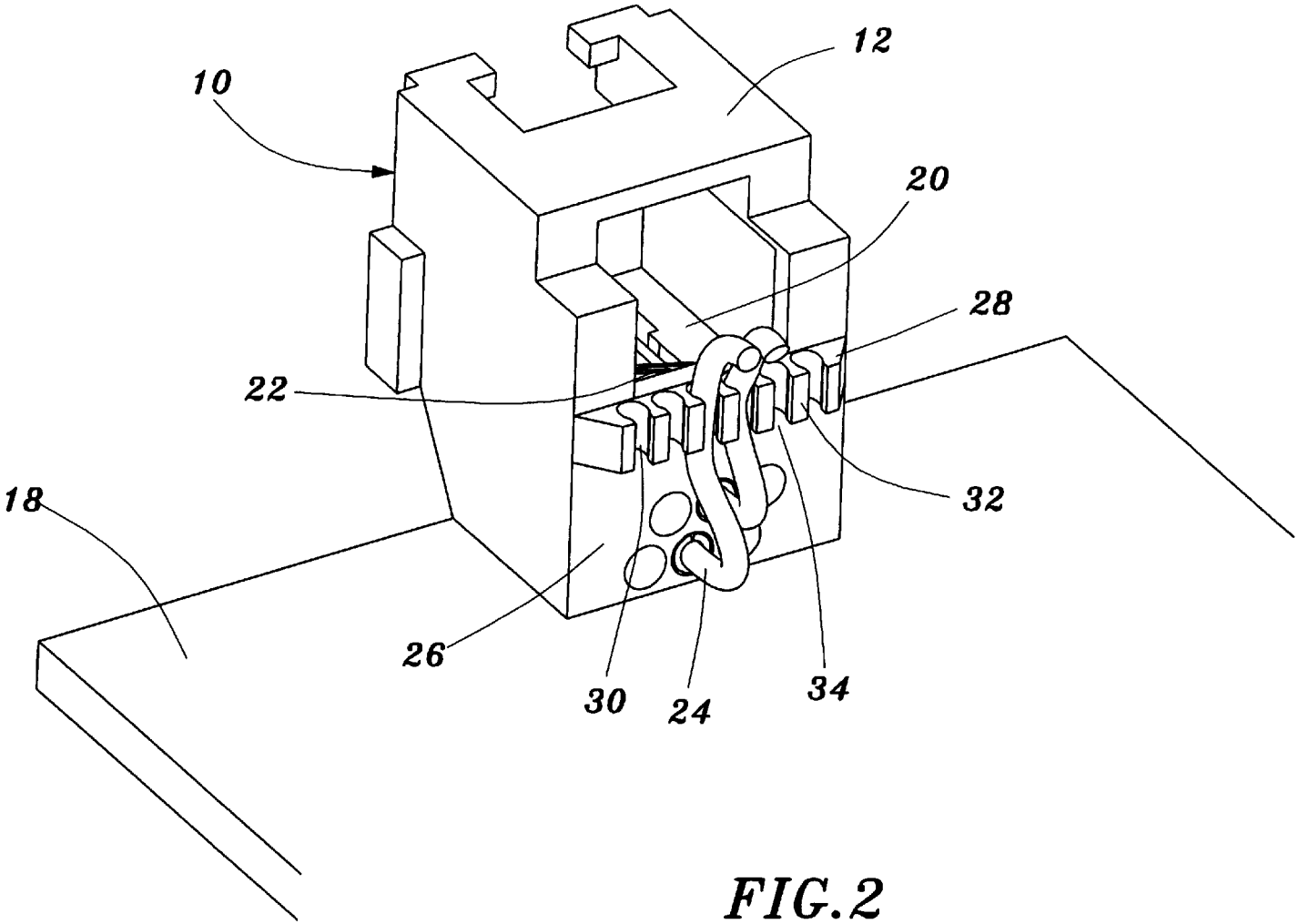
FIG. 2 is a rear perspective view of the modular jack mounted to the PCB.

Referring to FIGS. 1 and 2, a modular jack 10 in accordance with the present invention includes an insulative housing 12 defining channels 14 along opposite lower sides thereof whereby the housing 12 can be retained in a cutout 16 defined in a PCB 18 to be received in an electronic device (not shown). A cavity 20 is defined in the housing 12 and exposed to an exterior of the electronic device for receiving a mating plug connector (not shown) therein. A plurality of contacts 22 extend into the cavity 20 for electrically connecting with contacts of the plug connector at one end thereof. The other end of the contacts 22 electrically connect with wires 24 extending from a lower portion of a rear face 26 of the housing 12.

A retaining spacer 28 is integrally formed on a middle portion of the rear face 26 of the housing 12. The spacer 28 defines a plurality of grooves 30 for snugly receiving a corresponding plurality of wires 24 therein, respectively. Retainers 32 having a certain degree of resiliency are formed between adjacent grooves 30 for holding the wires 24 in place. An opening 34 is defined between adjacent retainers 32 whereby each groove 30 communicates with an exterior of the housing 12 through the corresponding opening 34 wherein the dimension of the opening 34 is smaller than the groove 30. Each wire 24 is forcibly inserted through the opening 34 of the corresponding groove 30 whereby the corresponding retainers 32 are forced outward until the wire 24 is received and retained within the corresponding groove 30. The wires 24 are then electrically connected with corresponding components (not shown) on the PCB 18.

The provision of the retaining spacer 28 promotes conservation of space on the PCB 18 on the portion thereof adjacent to the rear face 26 of the housing 12 of the modular jack 10. Thus, other electrical components can be mounted closer to the rear face 26 of the housing 12 of the modular jack 10 without interfering with the wires 24 thereof.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical connector comprising:

an insulative housing defining a cavity therein for receiving a mating plug connector;

a plurality of contacts extending into the cavity and electrically connecting with a corresponding plurality of wires extending from a rear face of the housing; and a retaining spacer integrally formed on the rear face of the housing and retaining portions of the wires therein, said retaining spacer defining a plurality of grooves snugly receiving corresponding wires therein, respectively, and forming resilient retainers between adjacent grooves holding the wires in place, an opening being defined between adjacent retainers whereby each groove communicates with an exterior of the housing through a corresponding opening, a dimension of the opening being smaller than that of the groove;

whereby the a mount of space occupied by the wires is reduced.

2. An electrical connector assembly comprising:

a printed circuit board for reception in an electronic device;

an insulative housing having a front face, a rear face, and two side walls, the housing being attached to the printed circuit board and defining a cavity in the front face thereof exposed to an exterior of the electronic device for receiving a mating plug connector therein;

a plurality of contacts extending into the cavity for electrically connecting with contacts of the plug connector at one end thereof, the other end of the contacts electrically connecting with wires extending from the rear face of the housing;

a retaining spacer integrally formed on the rear face of the housing retaining portions of the wires therein; said retaining spacer defining a plurality of grooves snugly receiving corresponding wires therein, respectively, and forming resilient retainers between adjacent grooves for holding the wires in place, an opening being defined between adjacent retainers whereby each groove communicates with an exterior of the housing through a corresponding opening;

whereby the retaining spacer promotes conservation of the space on the PCB on the portion thereof adjacent to the rear face of the housing of the electrical connector assembly.

3. The electrical connector assembly as described in claim 2, wherein the dimension of the opening is smaller than the groove.

4. The electrical connector assembly as described in claim 2, wherein the housing defines channels along a lower portion of each of the side walls thereof whereby the housing can be retained in a cutout defined in the PCB.

5. An electrical connector for mounting to a printed circuit board, comprising:

an insulative housing defining channels for the electrical connector being retained in a cutout defined in the printed circuit board;

a plurality of contacts side by side positioned within the housing, said contacts including rear ends mechanically and electrically connected to corresponding wires, respectively; and means for retaining the wires in position;

wherein the wires are restrainably upward extended through the retaining means and parallel to a rear face of the housing for conserving a space around the connector on the printed circuit board.

* * * * *